US009212458B2

(12) United States Patent
Kappel

(10) Patent No.: US 9,212,458 B2
(45) Date of Patent: Dec. 15, 2015

(54) ROAD PAVER

(71) Applicant: ABG Allgemeine Baumaschinen-Gesellschaft mbH, Hameln (DE)

(72) Inventor: Marc Kappel, Hameln (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

(21) Appl. No.: 14/406,688

(22) PCT Filed: May 2, 2013

(86) PCT No.: PCT/EP2013/001290
§ 371 (c)(1),
(2) Date: Dec. 9, 2014

(87) PCT Pub. No.: WO2013/185867
PCT Pub. Date: Dec. 19, 2013

(65) Prior Publication Data

US 2015/0152607 A1 Jun. 4, 2015

(30) Foreign Application Priority Data

Jun. 12, 2012 (DE) ..... 10 2012 011 693

(51) Int. Cl.
*E01C 19/17* (2006.01)
*E01C 23/00* (2006.01)
(Continued)

(52) U.S. Cl.
CPC ..... *E01C 19/42* (2013.01); *E01C 19/002* (2013.01); *E01C 19/176* (2013.01); *E01C 19/48* (2013.01); *E01C 23/00* (2013.01); *E01C 2301/50* (2013.01)

(58) Field of Classification Search
CPC ..... E01C 19/48; E01C 19/42; E01C 19/176; E01C 19/002; E01C 2301/50; E01C 23/00; F01N 13/002; F01N 13/082; F01N 13/08
USPC ..... 404/101, 83
See application file for complete search history.

(56) References Cited

U.S. PATENT DOCUMENTS 4,012,160 A * 3/1977 Parker ..... 404/84.05
5,443,325 A * 8/1995 Simonelli et al. ..... 404/75

(Continued)

FOREIGN PATENT DOCUMENTS

EP 0666373 A1 8/1995
EP 0843044 A1 5/1998

(Continued)

OTHER PUBLICATIONS

English translation of the International Search Report and Written Opinion of PCT/EP2013/001290.

(Continued)

*Primary Examiner* — Abigail A Risic
(74) *Attorney, Agent, or Firm* — Kilpatrick Townsend & Stockton LLP

(57) ABSTRACT

The invention relates to a road paver comprising a chassis that carries a driver's cab, an undercarriage, at least one drive assembly, a hydraulic system, a cover mounted in an articulated manner, an asphalt feed arrangement comprising a storage hopper, a longitudinal conveyor device which conveys material from the storage hopper to a cross-distributor, and a steam suction system which is operated by means of a vacuum generator and comprises at least one suction flow path whose withdrawal line comprises a suction inlet above the cross-distributor and an outlet at a height above the driver's cab. At the suction inlet-side end of said withdrawal line, at least one confuser-like inlet nozzle is provided which is arranged to be secured to, and movable with, said cover, and which aspirates behind the cross-distributor in the travel direction such that accessibility in the region above the cross-distributor is not affected and the view out to the cross-distributor from the driver's cab is not obscured.

10 Claims, 11 Drawing Sheets

Figure 1:
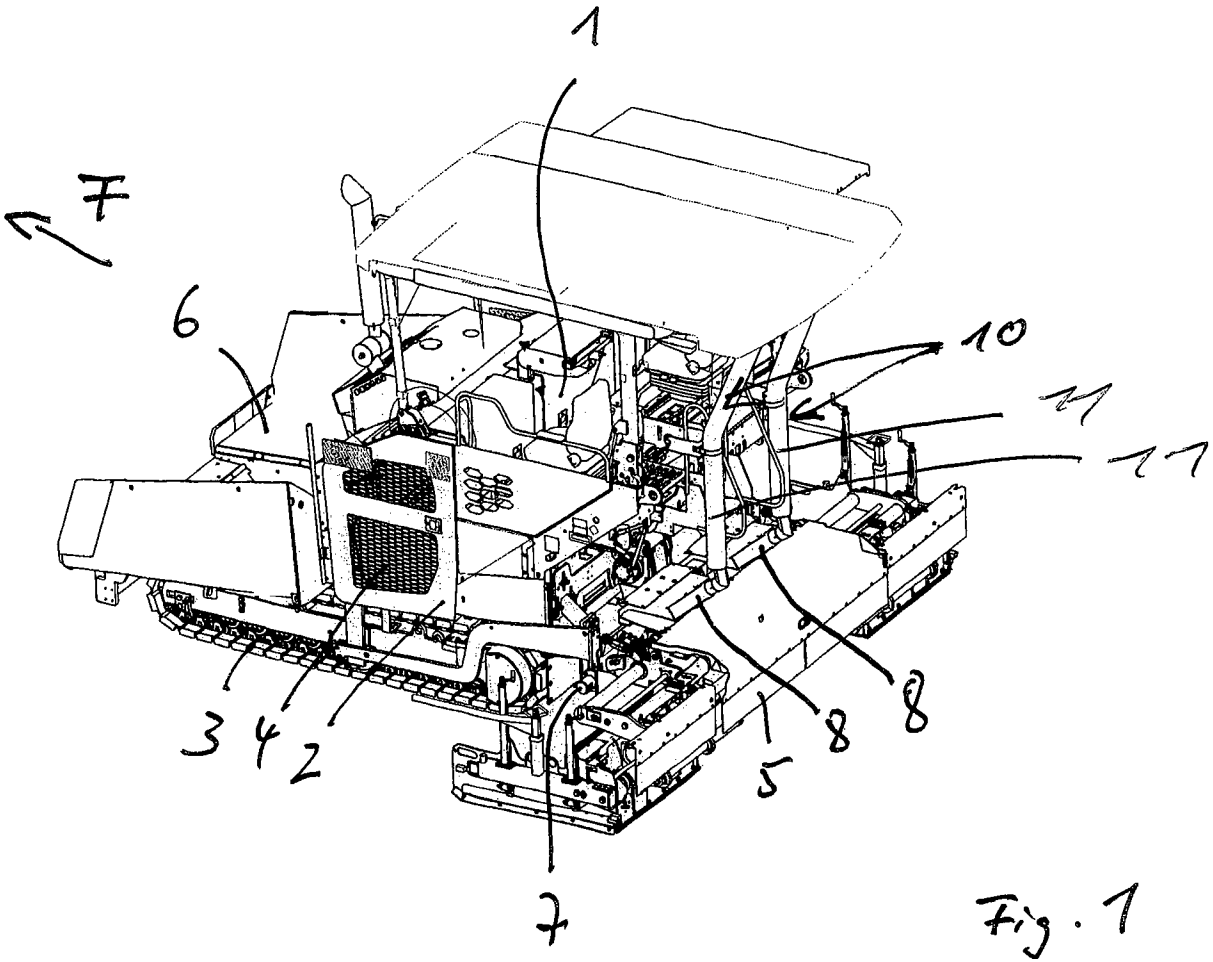

(51) Int. Cl.

| | |
|---|---|
| ***E01C 19/42*** | (2006.01) |
| ***E01C 19/48*** | (2006.01) |
| ***E01C 19/00*** | (2006.01) |

(56) References Cited

U.S. PATENT DOCUMENTS

| | | | | |
|---|---|---|---|---|
| 5,938,371 | A * | 8/1999 | Gustin et al. | 404/108 |
| 6,152,649 | A * | 11/2000 | Snyder et al. | 404/101 |
| 6,832,872 | B2 * | 12/2004 | Koelm et al. | 404/108 |
| 7,491,012 | B2 * | 2/2009 | Weiser | 404/108 |
| 2006/0204333 | A1 * | 9/2006 | Musil | 404/95 |
| 2015/0104256 | A1 * | 4/2015 | Komm et al. | 404/101 |

FOREIGN PATENT DOCUMENTS

| | | | |
|---|---|---|---|
| EP | 0937182 | B1 | 11/2004 |
| WO | WO2004/044331 | A1 | 5/2004 |

OTHER PUBLICATIONS

International Search Report and Written Opinion of PCT/EP2013/001290, dated Aug. 30, 2013, 8 pages.

* cited by examiner

ROAD PAVER

The invention relates to a road paver according to the preamble of claim 1.

An asphalt paving machine is disclosed in EP 0 937 182 B1 and U.S. Pat. No. 5,938,371, said asphalt paving machine being provided with a suction system for removing harmful fumes which are emitted from the asphalt material. One noticeable disadvantage which occurs when processing asphalt is that the petroleum distillates in the asphalt tend to emit substantial amounts of hydrocarbons and other foul smelling fumes when the asphalt is heated. Said fumes can comprise nitrogen, sulfur, benzene and other aromatic hydrocarbons, of which many are poisonous. Health risks can therefore be caused for the operators of the asphalt paving machines and for other road construction people who typically spend a large amount of time in the direct vicinity of the asphalt paving machines.

To remove fumes from the asphalt on the asphalt paving machine, the known suction system has an air ducting system with a ducting part extending in the longitudinal direction and which extends along a conveyor for transporting the asphalt in the asphalt paving machine from a container to distributor augers, so that along this conveyor section and at the ends thereof fumes can be drawn into an air plenum of the ducting part and ejected via an air outlet part. The air outlet part is attached to the air plenum, is in communication therewith and extends to a height above the control station. A fan is arranged inside the air plenum in order to draw in air via the ducting part inlets and to eject air through the air outlet part. The fan is preferably a radial fan but may have any other type of conventional construction and be driven by an electrical or hydraulic motor. Such a suction system borne by the body of the asphalt paving machine is relatively cost-effective to construct. However, frequently the quantity of fumes is insufficiently minimized and the cleaning and maintenance effort is high, due to deposits in the air ducting system. Furthermore, it is disadvantageous that installation space is occupied in the paver.

It is disclosed in WO 2004/044331 A1 to position above the distributor augers of a paver the inlets of two separate ducting systems with fans arranged in the air spaces. However, once again the quantity of fumes is often insufficiently minimized here and the cleaning and maintenance effort is in turn high, due to deposits in the air ducting system. Furthermore, the view onto the distributor augers is greatly restricted.

It is the object of the invention, therefore, to provide a road finishing machine with a suction system for noxious fumes when processing asphalt, the efficiency thereof in minimizing the quantity of fumes, in particular bitumen fumes, which could harm the operator of the machine being improved and at the same time said suction system being cost-effective to construct and to maintain.

This object is achieved by the features of claim 1.

Hereby a road finishing machine is provided with a suction system for fumes, in particular bitumen fumes, which provides a better suction performance than suction funnels of only short design above a transverse distributor. The screed weight is only increased minimally, since fans can still be installed on the paver. The suction system can be implemented as a screed option, retrofitting on site being readily possible. Fastening to the screed also makes raising of the suction system installation or parts thereof, namely its inlet nozzles, possible, as a result of which the risk of contamination during transport journeys is reduced.

A further great advantage is that the suction system according to the invention does not affect the accessibility in the region above the transverse distributor, in particular above the distributor augers, and additionally the view onto the transverse distributor from the driver's cab is not obscured. The fan can be positioned below a platform of the driver's cab and can therefore be moved out of the field of vision.

The at least one confusor-like inlet nozzle provides for uniform suction along the transverse distributor, with the result that suction can take place over the complete width in the screed. Here, the suction flow can be guided by means of one or more guiding plates on the inlet nozzle, as a result of which the suction performance can be improved further.

For upper-side shielding of the bitumen fumes which rise up along the transverse distributor, an air flushing covering the suction flow can be provided, in which air flushing a shielding air layer can be provided by means of a blowing device, which air layer reverses the bitumen fumes which rise up.

The suction flow can be adjusted by means of the output of the fan and/or the opening width of the suction opening.

Further advantages and embodiments of the invention can be gathered from the following description and the dependent claims.

Figure 2:
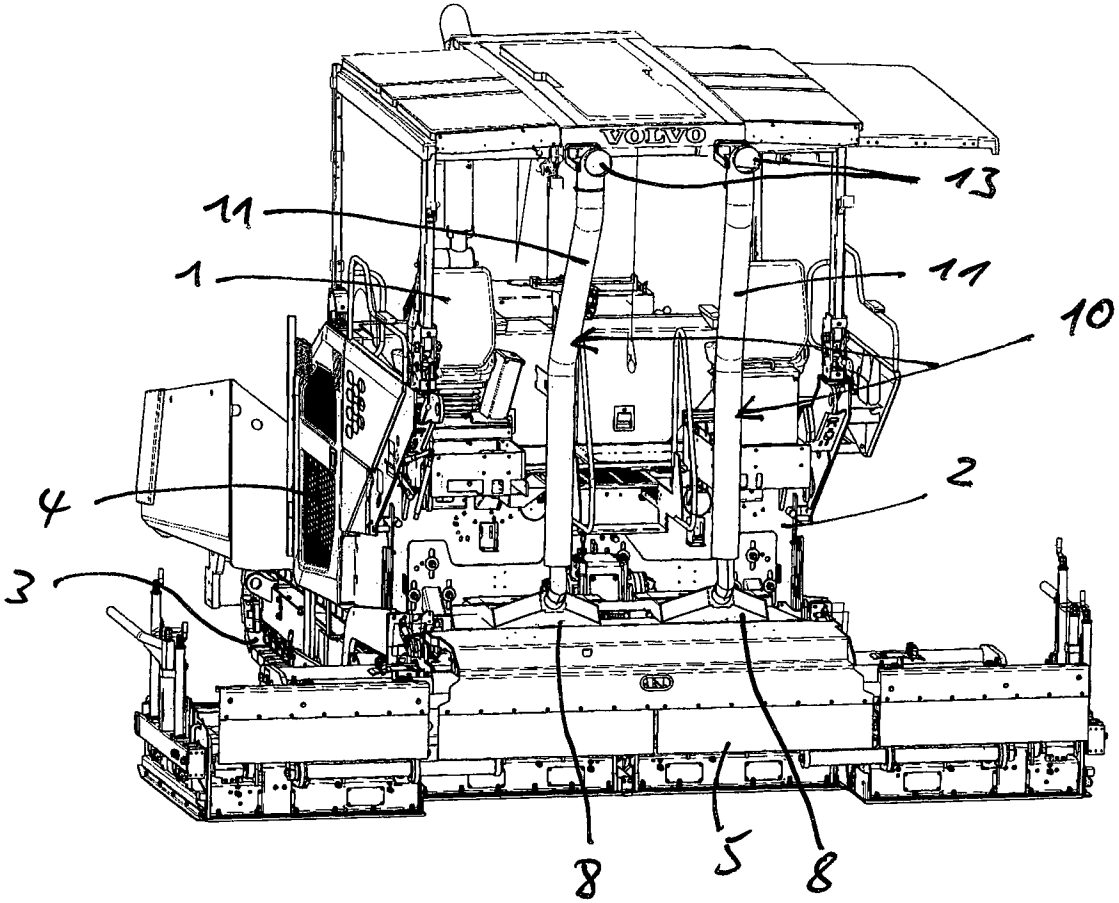
Figure 3:
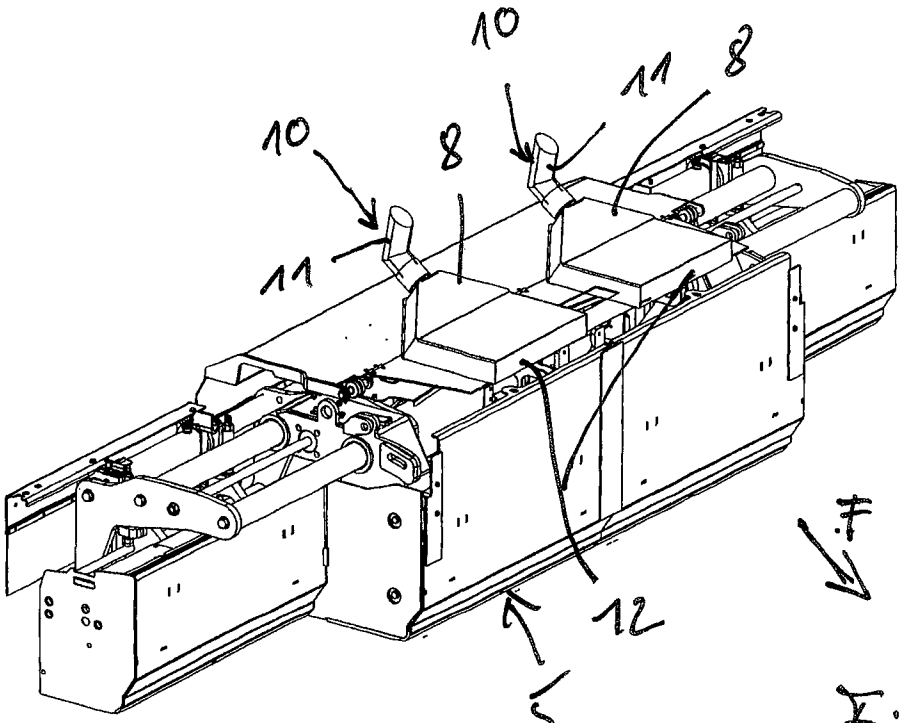
Figure 4:
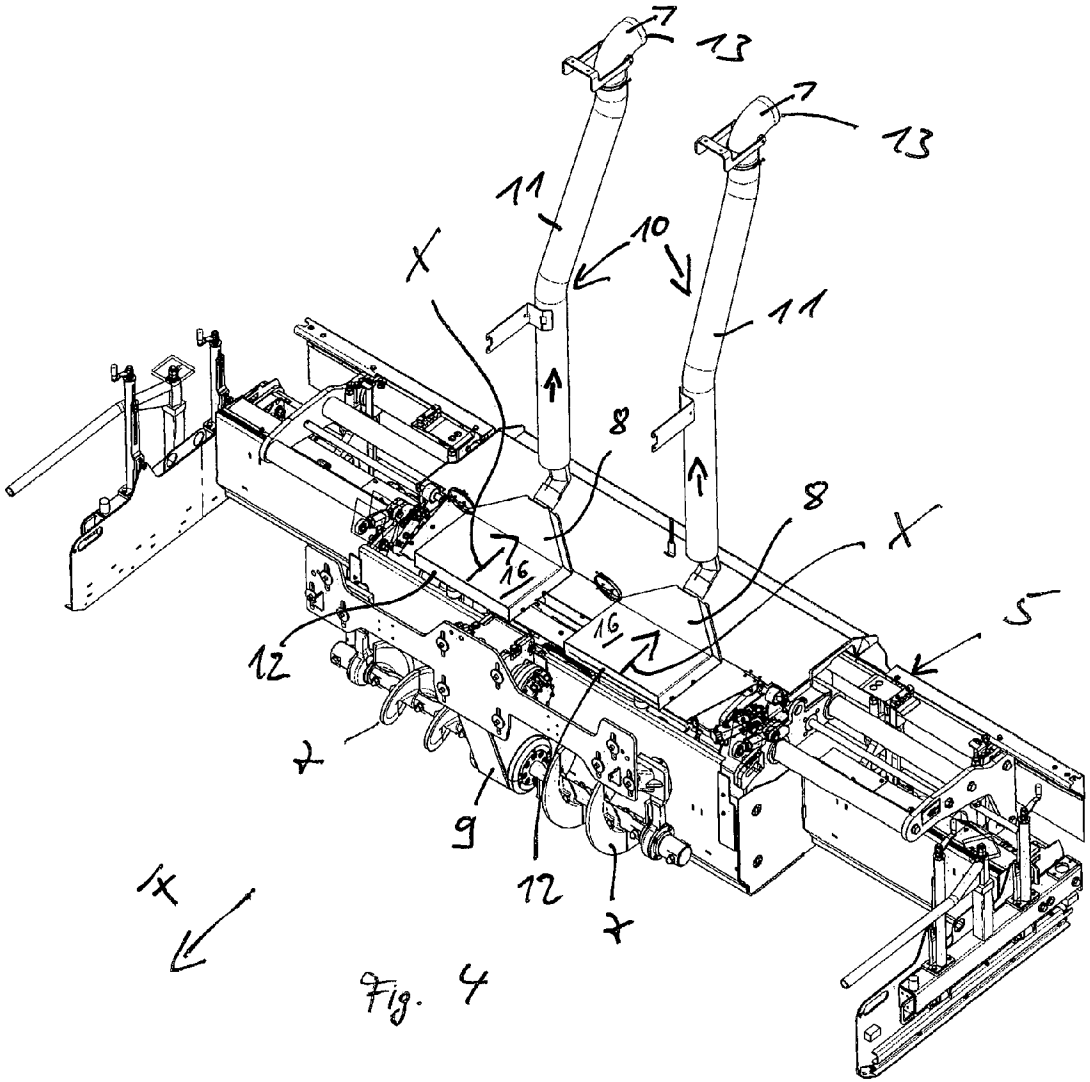
Figure 5:
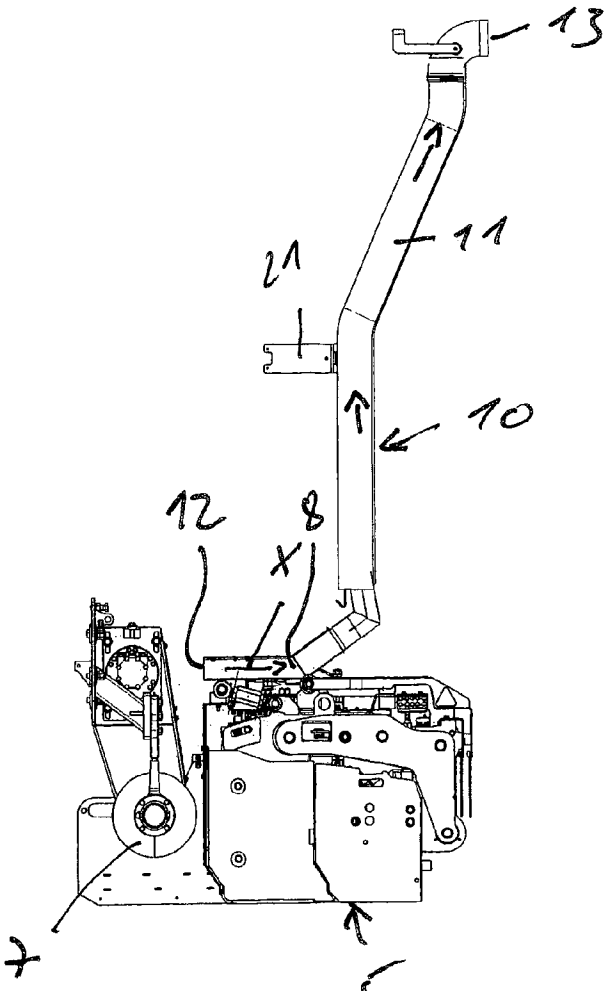
Figure 6:
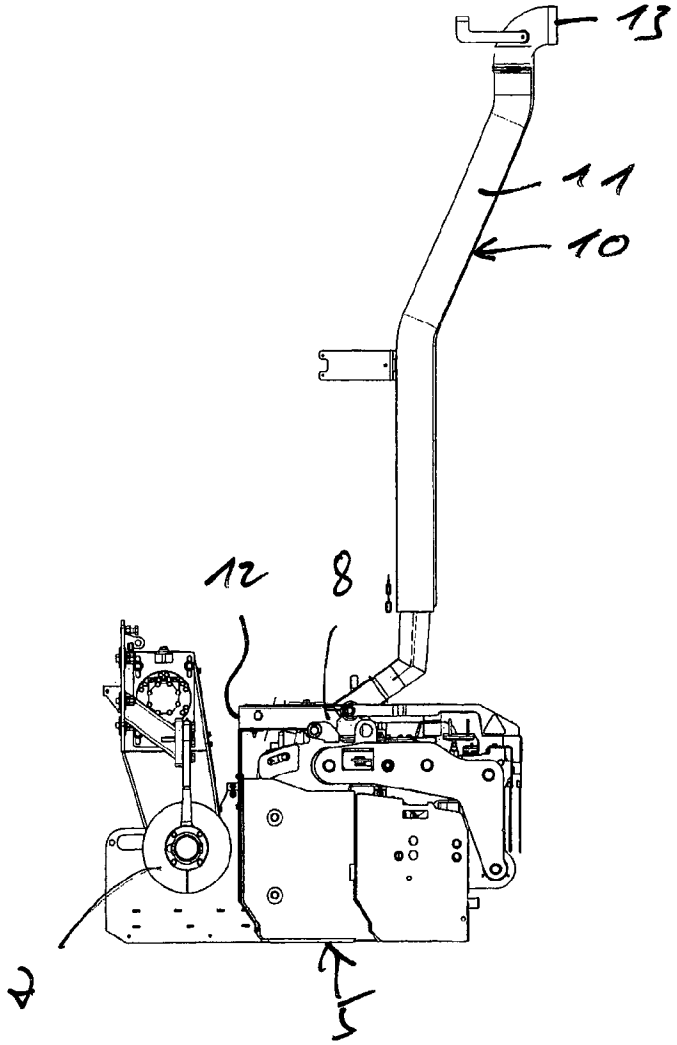
Figure 7:
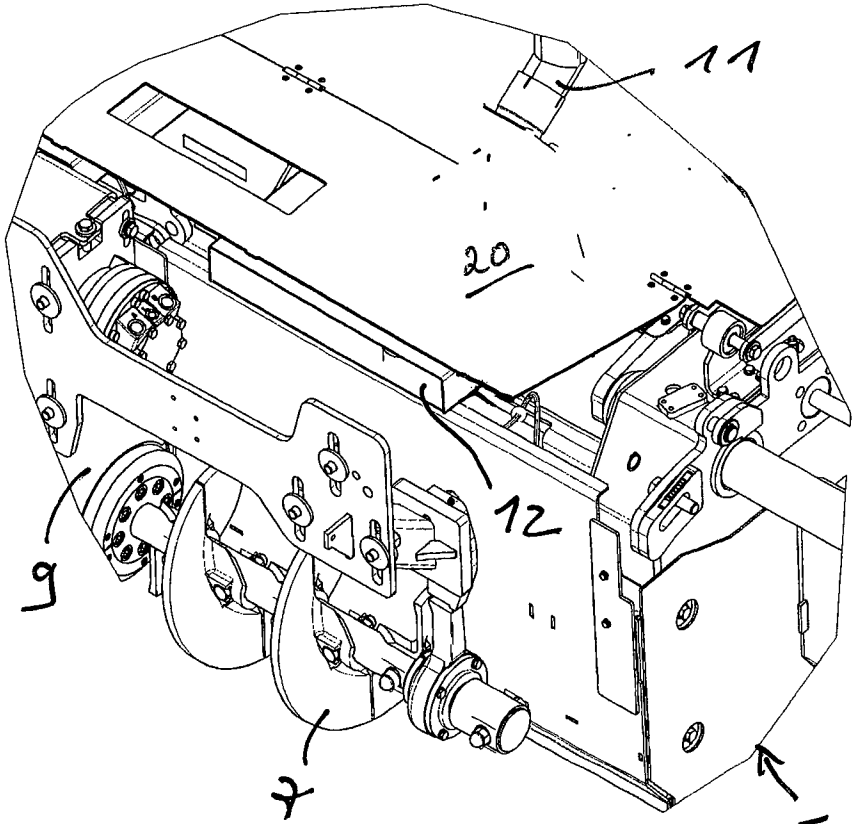
Figure 8:
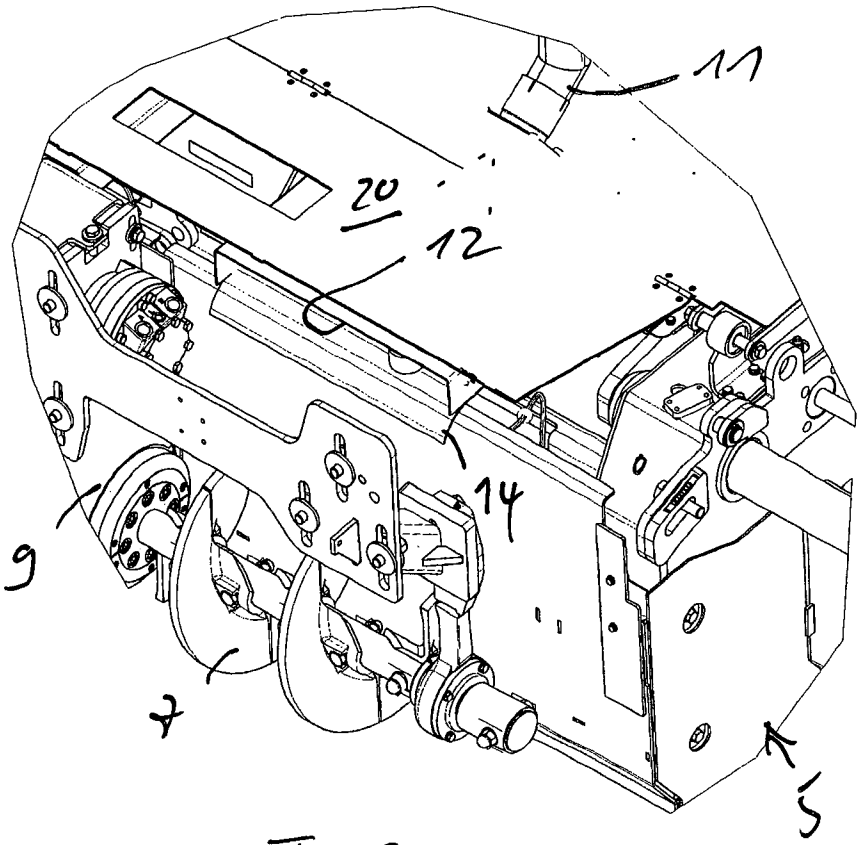
Figure 9:
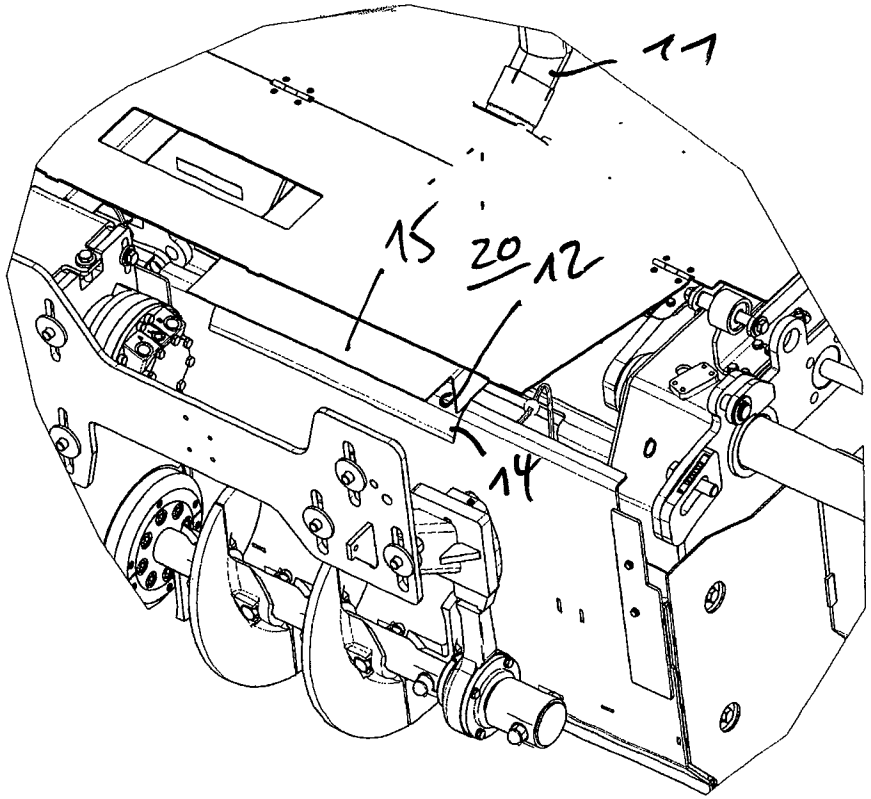
Figure 10:
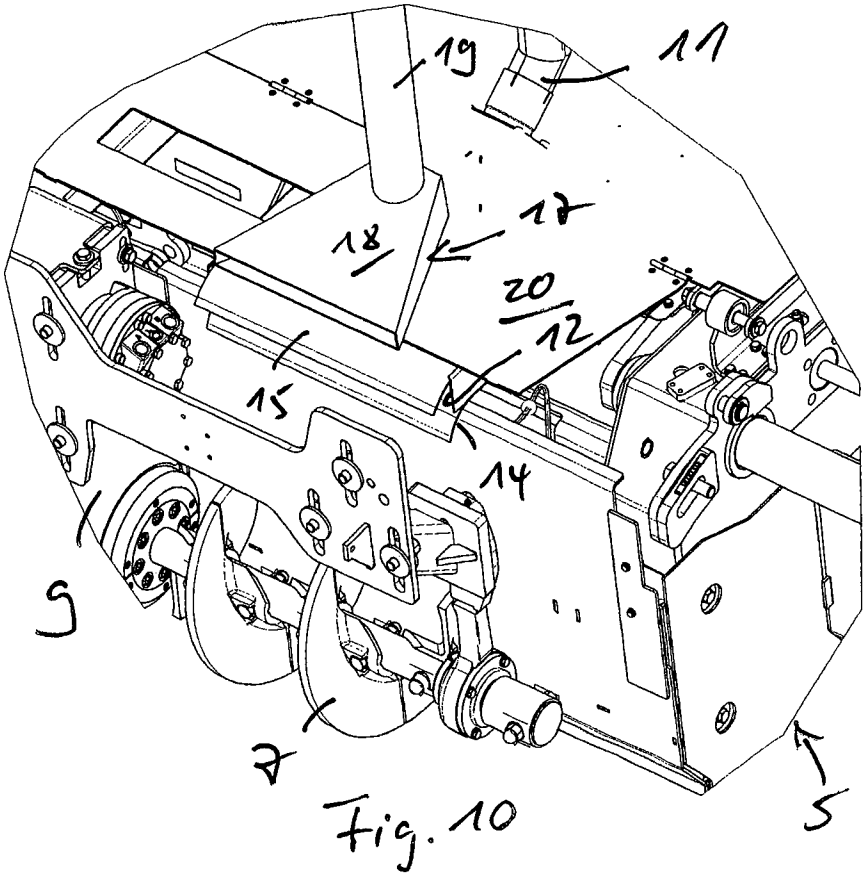
Figure 11:
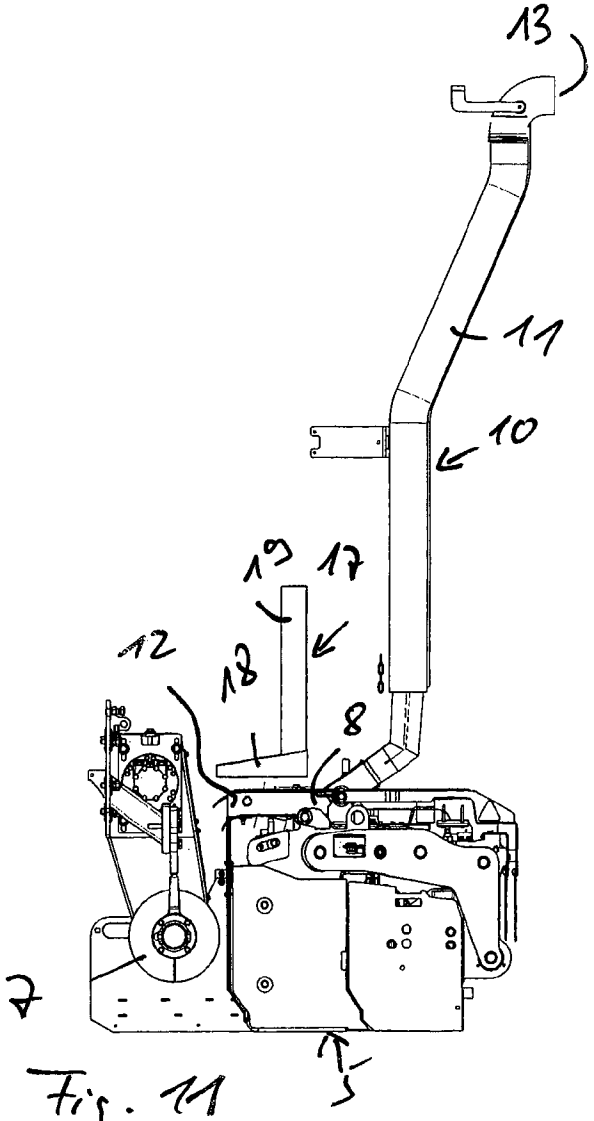

The invention is explained in more detail hereinafter with reference to the exemplary embodiments shown in the accompanying drawings, in which:

FIG. 1 shows schematically a perspective view, obliquely from behind, of a road finishing machine having a fumes suction system, in particular for bitumen fumes, FIG. 2 shows schematically a rear view of the road finishing machine according to FIG. 1, FIG. 3 shows a screed of the road finishing machine according to FIG. 1 in an enlarged illustration, FIG. 4 shows schematically a view of the screed according to FIG. 2 together with a transverse distributor and parts of a fumes suction system, namely detached from a chassis of the road finishing machine, FIG. 5 shows schematically a side view of FIG. 4, FIG. 6 shows schematically a side view of a screed according to another exemplary embodiment, FIG. 7 shows schematically a view of a part of the screed in the region of an inlet nozzle of the fumes suction system with a screed cover according to FIG. 6, FIG. 8 like FIG. 7 shows schematically a view of a part of the screed having a fumes suction system with an inlet nozzle with a lower flow guiding plate, FIG. 9 shows schematically a view of the exemplary embodiment according to FIG. 6 having an inlet nozzle with a lower and an upper flow guiding plate, FIG. 10 like FIG. 7 shows schematically a view of a part of the screed in the region of an inlet nozzle of the fumes suction system with an additional blower device for an air flushing, FIG. 11 shows schematically a side view of FIG. 10.

FIG. 1 and FIG. 2 show a road finishing machine having a chassis 2 which supports a driver's cab 1, an undercarriage 3, at least one drive unit 4, a hydraulic system, a screed 5 and an asphalt supply arrangement comprising a storage hopper 6 and a longitudinal conveyor conveying from the storage hopper 6 to a transverse distributor 7. This is a conventional design for a paver. The undercarriage 3 can be a crawler undercarriage or a wheeled undercarriage. The longitudinal conveyor preferably comprises two conveyor belts which run in parallel, in order to be able to feed separately a right-hand and a left-hand part of the transverse distributor 7. The transverse distributor 7 is preferably configured as a distributor auger with a preferably centrally arranged auger drive 9, as can be seen from FIG. 4.

As, in particular, FIG. 3 to FIG. 5 show in detail, the road finishing machine comprises, furthermore, a fumes suction system 10 which is operated by means of a vacuum generator and has at least one suction flow path X (cf. FIG. 4 and FIG. 5), the exhaust line 11 of which has a suction opening 12 above the transverse distributor 7 and an outlet opening 13 at a level above the driver's cab 1.

At least one confusor-like inlet nozzle 8 is mounted on and moveable with the screed 5 and is provided at the intake-side end of the exhaust line 11, wherein the at least one confusor-like inlet nozzle 8 applies suction behind the transverse distributor 7 in the direction of travel F. The fastening to the screed 5 which can be of detachable configuration has the effect that the confusor-like inlet nozzle 8 forms a unit with the screed 5 and is enforced to move into a working position by way of said screed 5 at those times when the suction is required.

By means of the confusor-like design of the inlet nozzle 8 it can be ensured that a uniform suction of the bitumen fumes which are produced in the region of the transverse distributor 7, in particular in an auger channel, is effected. The dimensions and/or the number of confusor-like inlet nozzles can be selected in such a way that the bitumen fumes are removed by suction over the complete width of a screed section, in particular of the basic screed. The bitumen fumes which rise up from the transverse distributor 7 are sucked in substantially transversely with respect to the rising direction through the suction opening 12 which preferably is the inlet area of the confusor-like inlet nozzle 8, with the result that the bitumen fumes are deflected by way of the suction.

The at least one confusor-like inlet nozzle 8 is preferably designed as a flat confusor and can be arranged above or below a screed cover 20. FIGS. 1 to 5 show the arrangement of the inlet nozzles 8 above the screed cover 20. FIGS. 6 to 11 show the arrangement of the inlet nozzles 8 below the screed cover 20. As a result, a suctioning can be realized between the screed 5 and its screed cover 20. To this end, the screed cover 20 can be installed in a manner which is elevated by a few centimeters. The cavity which is produced thereby can be utilized to accommodate the confusor-like inlet nozzle or nozzles 8. As a result, parts of the fumes suction system 10 are protected and are moved into position by way of the screed 5 when the fumes suction system is required, i.e. when the screed 5 is lowered.

The flow velocity over the entirety of the suction area of the suction opening 12 can be set by means of a cross-sectional reduction of the at least one confusor-like inlet nozzle 8, which cross-sectional reduction can be selected in the direction of flow. On account of the cross-sectional reduction which takes place in the direction of flow, the flow velocity in the confusor-like inlet nozzle 8 increases. Non-uniform flow velocities in the suction flow path X are therefore homogenized by means of the inlet nozzle 8 according to the invention, with the result that approximately identical flow velocities prevail over the entire suction opening 12. A flow velocity which is homogenized in this way leads to the bitumen fumes which rise up being removed by suction very uniformly and quasi at a right angle when said bitumen fumes attempt to move past the suction opening 12.

The confusor-like inlet nozzle 8 can have a chamber-like attachment 16 (cf. FIG. 4) on the intake side and can optionally be provided with an apron 14 being drawn downwards which provides a flow guiding plate, as shown in FIG. 8. As FIG. 9 shows, a second apron 15 can be provided which can be designed to be drawn upwards.

As FIG. 6 shows, the exhaust line 11 can be a telescopic tube, for enabling it to follow a raising and lowering of the screed 5.

The vacuum generator can be a fan, not shown. Such a fan can operate at an output of 1000 to 3000 $m^3$/h air volume flow. The nominal width of the exhaust line 11 can be in the range from 100 to 200 mm.

In general, the transverse distributor 7 has a right-hand and a left-hand section to each of which preferably one vacuum flow path X is assigned which is provided with a confusor-like inlet nozzle 8. The fumes suction system 10 can have a selectable number of suction flow paths X each having at least one suction opening 12 and one exhaust line 11. Depending on requirements, the number can be selected and the operation of a plurality of suction flow paths X can be electronically coordinated.

As FIG. 10 and FIG. 11 show, according to a further exemplary embodiment of the invention, a blowing device 17 for generating an air flushing which covers the suction flow is assigned to the respective confusor-like inlet nozzle 8. The blowing device 17 blows off the air flushing above the respective confusor-like inlet nozzle 8 in order to generate a horizontal air layer which shields the suction means. To this end, the blowing device 17 can have a flat nozzle 18 which is arranged in the region of the inlet nozzle 8 and is connected to an air supply 19. Here, the air which is fed in can be taken from the air sucked off. The aprons 14, 15 which are provided according to FIG. 10 and FIG. 11 are provided merely preferably.

The exhaust lines 11 can be fastened via holders 21 to the chassis 2 of the road finishing machine.

The invention claimed is:

1. Road finishing machine having a chassis which supports a driver's cab, an undercarriage, at least one drive unit, a hydraulic system, a screed which is mounted in an articulated manner, and an asphalt supply arrangement comprising a storage hopper and a longitudinal conveyor conveying from the storage hopper to a transverse distributor, and having a fumes suction system which is operated by means of a vacuum generator and has at least one suction flow path, the exhaust line thereof having a suction means above the transverse distributor and an outlet at a level above the driver's cab, wherein at least one confusor inlet nozzle is mounted on and moveable with said screed and is provided at the intake-side end of the exhaust line, wherein said at least one confusor inlet nozzle applies suction behind the transverse distributor in the direction of travel and wherein the confusor inlet nozzle is mounted on the screed such that a region above the transverse distributor remains accessible and a view onto the transverse distributor from the driver's cab is not obstructed.

2. Road finishing machine according to claim 1, wherein the at least one confusor inlet nozzle is arranged as a flat confusor above or below a screed cover.

3. Road finishing machine according to claim 1, wherein the flow velocity is settable over the entirety of a suction area of the suction opening by means of a cross-sectional reduction of the at least one confusor inlet nozzle, said cross-sectional reduction being selectable in the direction of flow.

4. Road finishing machine according to claim 1, wherein an inlet area of the at least one confusor inlet nozzle is provided with at least one apron as a flow guiding plate.

5. Road finishing machine according to claim 1, wherein the vacuum generator is a fan.

6. Road finishing machine according to claim 5, wherein the fan operates at an output of 1000 to 3000 m3/h air volume flow.

7. Road finishing machine according to claim 1, wherein the nominal width of the exhaust line is in the range from 100 to 200 mm.

8. Road finishing machine according to claim 1, wherein the transverse distributor has a right hand and a left-hand section to each of which one vacuum flow path is assigned which is provided with a confusor inlet nozzle.

9. Road finishing machine according to claim 1, wherein a blowing device for generating an air flushing which covers the suction flow is assigned to the respective confusor inlet nozzle.

10. Road finishing machine according to claim 9, wherein the blowing device blows off the air flushing above the respective confusor inlet nozzle in order to generate a horizontal air layer which shields the suction means.

* * * * *